US007779488B2

(12) United States Patent
Fukasawa

(10) Patent No.: US 7,779,488 B2
(45) Date of Patent: Aug. 24, 2010

(54) SWIMMING GOGGLES

(75) Inventor: Shunji Fukasawa, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 586 days.

(21) Appl. No.: 11/858,618

(22) Filed: Sep. 20, 2007

(65) Prior Publication Data

US 2008/0072366 A1 Mar. 27, 2008

(30) Foreign Application Priority Data

Sep. 21, 2006 (JP) ..... 2006-256354

(51) Int. Cl.
*A61F 9/02* (2006.01)

(52) U.S. Cl. ..... 2/428

(58) Field of Classification Search ..... 2/9, 2/428

See application file for complete search history.

(56) References Cited

U.S. PATENT DOCUMENTS 6,721,963 B1 * 4/2004 Kawashima ..... 24/426
6,810,536 B2 * 11/2004 Yamamoto et al. ..... 2/428
6,996,857 B2 * 2/2006 Fukasawa ..... 2/428
7,552,484 B2 * 6/2009 Seynhaeve et al. ..... 2/440

FOREIGN PATENT DOCUMENTS

JP 2005-160941 6/2005

* cited by examiner

*Primary Examiner*—Katherine Moran
(74) *Attorney, Agent, or Firm*—Brinks Hofer Gilson & Lione

(57) ABSTRACT

Swimming goggles includes lens units each made of transparent hard material, lens frame units each made of hard material and gasket units each made of soft and elastic material. Each of the gasket units is formed along an outer peripheral surface thereof with a convex rib.

4 Claims, 5 Drawing Sheets

SWIMMING GOGGLES

BACKGROUND OF THE INVENTION

The present invention relates generally to swimming goggles adapted to be put on a wearer's face for swimming whether it is competitive or not.

Swimming goggles typically comprise a pair of lens units, a pair of lens frame units molded or held integrally with the lens units, a pair of gasket units joined integrally to the lens frame units and having portions adapted to come in contact with the wearer's face, a nose bridge serving to couple respective inner ends of the lens frame units, and a head strap serving to couple respective outer ends of the lens frame units. Numbers of swimming goggles having such typical construction have already been proposed or commercially available and one of them is disclosed in Japanese Unexamined Patent Application Publication No. 2005-160941 (hereinafter referred to as "REFERENCE").

As will be understood in the light of the swimming goggles disclosed in REFERENCE, a pad unit (corresponding to the gasket unit) is made of an elastic material and a front region of the pad unit is integrally joined to an outer peripheral surface and the rear edge of the lens frame unit so as to cover them while a rear region of the pad unit extends rearward from an inner periphery of the rear edge of the front region and obliquely further extends outward so as to define a region destined to be in contact with the wearer's face. In such construction, a region defined between the rear edge and the region destined to come in contact with the wearer's face is formed on an outer peripheral surface of this region with a concave region having a substantially V- or U-shaped cross-section.

Generally in the swimming goggles disclosed, for example, in REFERENCE, the concave region is necessarily formed in the pad unit since the pad unit must be crooked in order to ensure that the region destined to be held in contact with the wearer's face should elastically held in close contact with the wearer's face although there may be some differences in depth and width of the concave region.

While it is essential for the goggles that the region destined to come in contact with the wearer's face is elastically held in close contact with the wearer's face in order to maintain a complete water-tightness within the goggles, it will be impossible to assure such perfect water-tightness if a pressure at which this region elastically bears against the wearer's face is relatively low. It is obviously supposed that the swimming goggles disclosed in REFERENCE have been designed so as to ensure such contact pressure to a certain degree. However, certain factors such as material, a thickness and cross-sectional shape of the pad unit may often constrain such design intending to maintain the desired contact pressure for a relatively long period. Even if the desired design is achieved, such elastic contact pressure is unavoidably decreased over time due to factors such as deterioration of the material forming the pad unit over time.

With the swimming goggles put on the wearer's face, the region destined to be held in close contact with the wearer's face of the pad unit is elastically deformed so as to come close to the rear edge of the front region of the pad unit as the region destined to be held in close contact with the wearer's face is pushed frontward. Even so, it is not expected that the concave region is perfectly closed. The concave region incompletely closed in this manner will generate a resistance against water flow which is undesirable particularly during competitive swimming.

SUMMARY OF THE INVENTION

In view of the problem as has been described above, it is an object of the present invention to provide swimming goggles improved to assure the elastic contact pressure by a simple measure and thereby to eliminate the resistance against water flow.

The object set forth above is achieved, according to the present invention, by an improvement in swimming goggles having frontward/rearward directions and a transverse direction being orthogonal thereto, comprising lens units each made of transparent hard material; annular lens frame units each made of hard material so as to extend from a peripheral edge of the associated lens unit in the rearward direction; annular gasket units each made of soft and elastic material so as to extend from a peripheral edge of the associated lens frame unit in the rearward direction wherein each of the gasket units comprising a first region integrally covering an outer peripheral surface of the associated lens frame unit and a second region extending from the outer peripheral surface along a rear edge of the associated gasket unit crooked inward as viewed in a radial direction of the associated lens frame unit and wherein an uneven concave region extends along the outer peripheral surface between the rear edge and the second region.

The improvement according to the present invention is in that each of the gasket units includes a convex rib integrally formed with the gasket unit from the soft and elastic material of the gasket unit so as to extend along the outer peripheral surface of the second region opposed to and spaced from the rear edge of the first region in the rearward direction.

In the swimming goggles according to one preferred embodiment of the invention, the first region of the gasket unit extends outward in the transverse direction to define an elastically deformable distal portion including no portion of the associated lens frame unit and the distal portion include, on its outer end, a buckle made of hard material and provided integrally with the outer end so as to serve for coupling of a head strap.

In the swimming goggles according to another preferred embodiment of the invention, the lens unit and the lens frame unit are integrally molded from the transparent hard material as an eye cup unit.

In the swimming goggles according to still another preferred embodiment of the invention, the eye cup unit and the gasket unit are integrally molded and thereby integrally joined to each other.

According to the present invention based on the construction as has been described above, the convex rib extending on the outer peripheral surface of the second region of the gasket unit ensures that the pressure at which the gasket is held in close contact with the wearer's skin is increased in comparison with the case in which the convex rib is absent, the water-tightness between the gasket unit and the wearer's face can be assured and the gasket is reliably prevent from being unintentionally deformed even if the swimming goggles are used for a relatively long period.

With the swimming goggles put on the wearer's face, the second region of the gasket unit is pushed toward the first region so as to be elastically deformed while the convex rib comes in contact with the rear edge of the first region and the concave region defined by the rear edge and the second region is closed. As an advantageous result, it is unlikely that any undesirable resistance against water flow might be generated during swimming whether it is competitive or not.

According to the embodiment in which the first region of the gasket includes the elastically deformable distal portion extending outward in the transverse direction and the distal portion is integrally provided on its outer end with the buckle made of hard material used to couple the head strap to the gasket unit, the elastically deformable distal portion allows the goggles to move in the back-to-forth direction as well as in the vertical direction and facilitates the wearer to fine adjust a relative position between the main body of the goggles and the head strap so far as the elasticity of said distal portion allows it.

According to the embodiment in which the lens unit and the lens frame unit are integrally molded from the transparent hard material as the eye cup unit while the eye cup unit and the gasket unit are integrally joined together, integration of the lens unit with the lens frame unit as well as integration of the lens frame unit with the gasket unit can be easily achieved without requirement for any complex steps. In addition, the desired water-tightness within the eye cup can be permanently assured unless the eye cut is damaged.

DETAILED DESCRIPTION OF THE PREFERRED EMBODIMENTS

Details of swimming goggles according to the present invention will be more fully understood from the description of a preferred embodiment thereof given hereunder with reference to the accompanying drawings.

Figure 1:
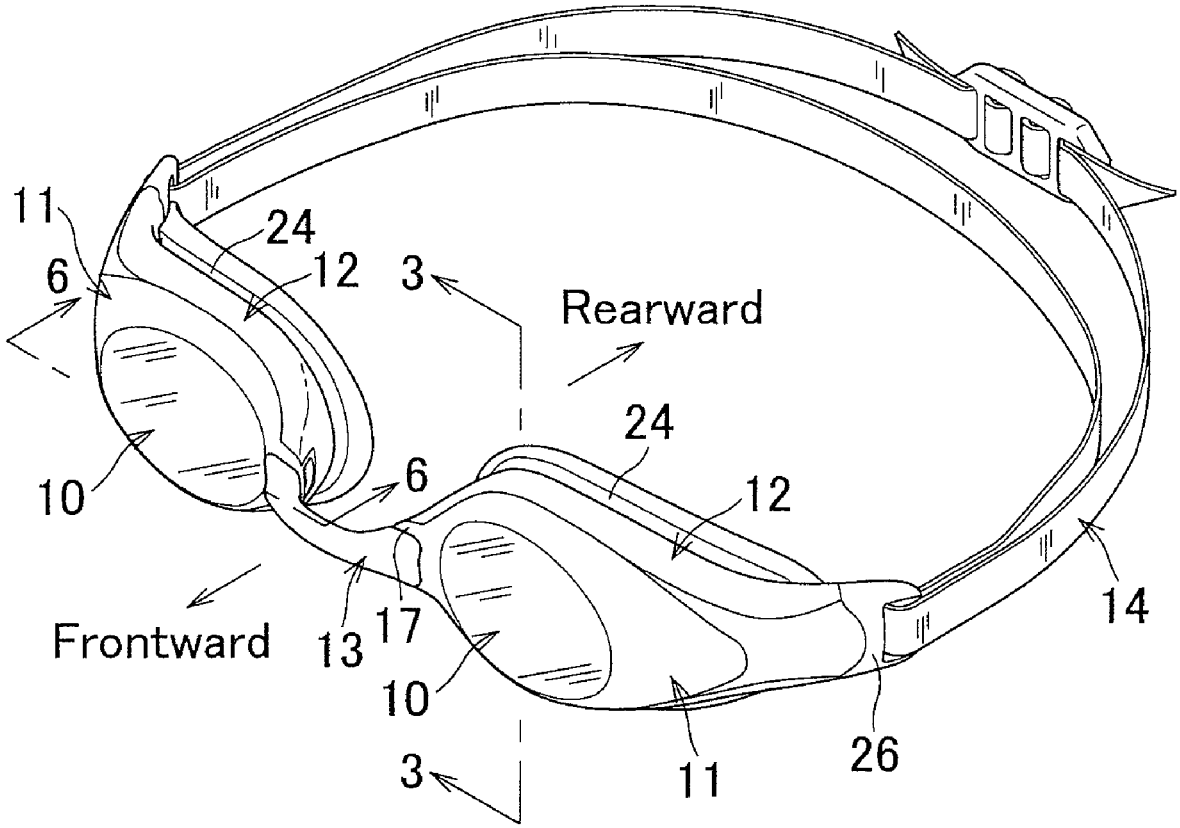
FIG. 1 is an overall perspective view of swimming goggles according to the present invention.
Figure 2:
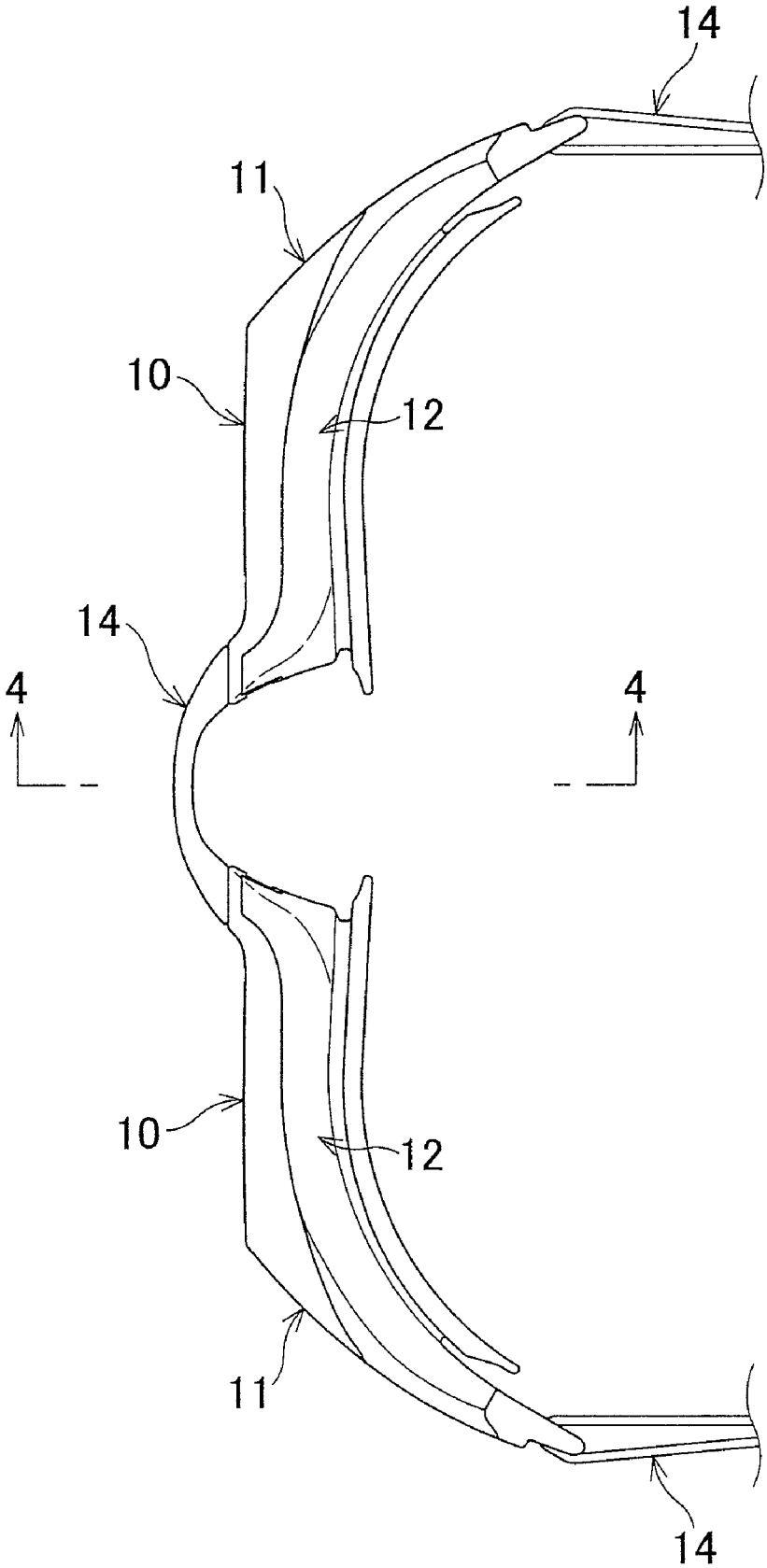
FIG. 2 is a scale-enlarged plan view of the goggles.
Figure 3:
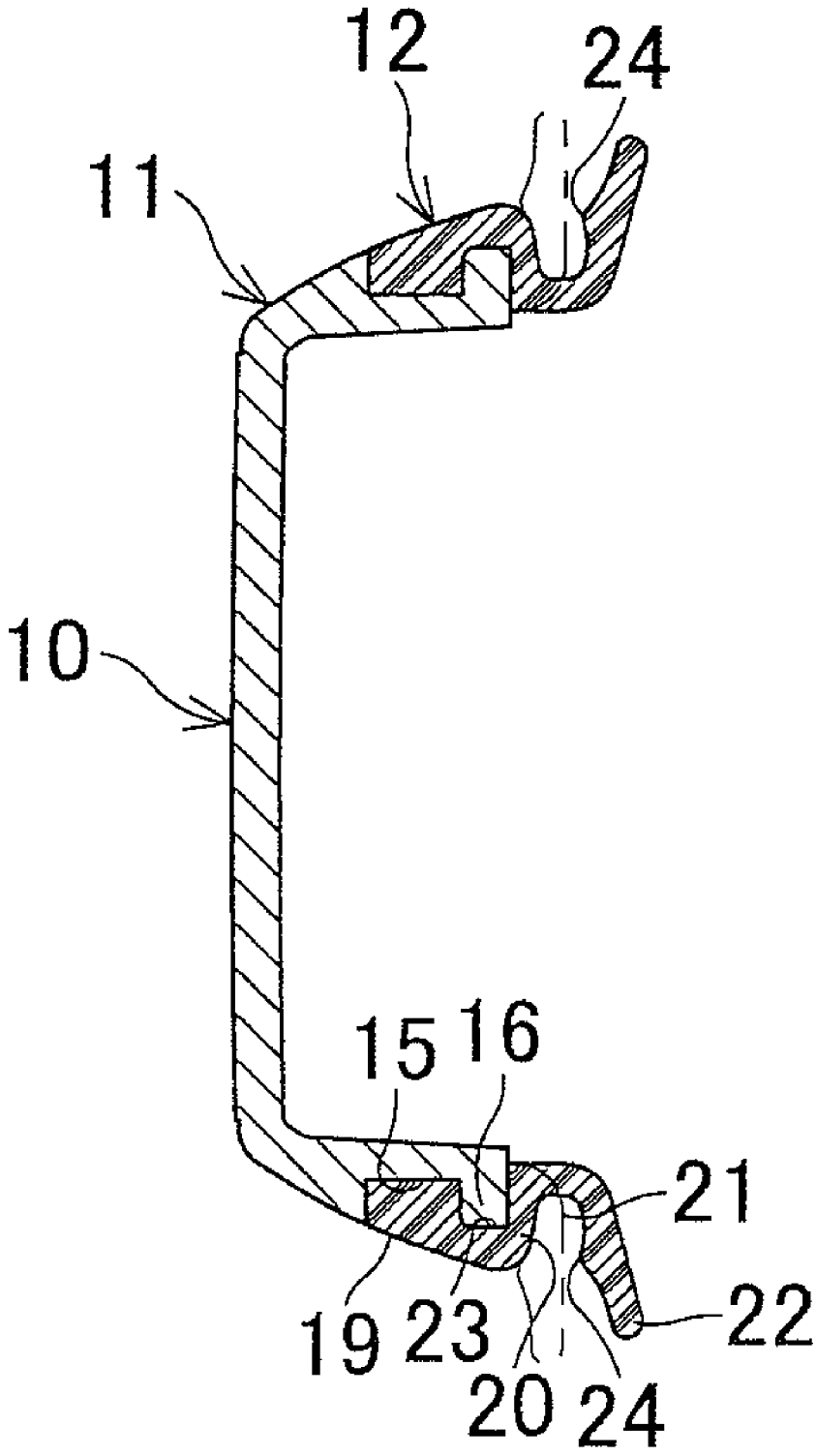
FIG. 3 is a scale-enlarged sectional view taken along the line 3-3 in FIG. 1.

As will be seen in FIGS. 1 through 3, swimming goggles having a frontward direction, a rearward direction and a transverse direction which is orthogonal to the front and rearward directions comprise a pair of lens units 10, a pair of annular lens frame units 11, a pair of annular gasket units 12, a transversely elongated strap-like nose bridge 13 and a head strap 14.

The lens units 10 and the lens frame units 11 are injection molded integrally together as a so-called eye cup unit from transparent hard material such as acryl- or carbonate-based plastic material. Each of the lens units 10 has an elliptical shape slightly longer in the transverse direction. The gasket units 12 are preferably formed from thermoplastic elastomeric material which is soft and has a relatively low elasticity such as olefin-, styrene-, urethane-, natural or synthetic rubber-based material. The gasket units 12 are integrated with the eye cup unit while the gasket units 12 are injection molded.

Although not shown, it is also possible to form the lens unit 10 and the lens frame unit 11 in separate steps so that the former may be put in engagement with groove extending along front inner peripheral edge of the latter and thereby the former may be integrated with the latter in a desired water-tight relationship, as well known with respect to the goggles of such type.

The lens frame unit 11 corresponds to the peripheral wall of the eye cup, which has a width as well as a length larger in the vicinity of its outer end (i.e., in the vicinity of outer corner of the wearer's eye than in the remaining unit. The lens frame unit 11 has a groove 15 extending along an outer peripheral surface thereof and a rear edge 16 defining a rear wall of this groove 15. The lens frame unit 11 is further provided on an internal side thereof, i.e., in the vicinity of the inner corner of the wearer's eye with a protuberance serving to support the nose bridge in a detachable manner and an outer edge 18 lying in the vicinity of the outer corner of the wearer's eye (See FIG. 6).

The gasket unit 12 comprises a first region 19, a crook region 20 extending inwardly of the lens frame unit 11 in a radial direction of the lens frame unit 11, and a second region 22 extending outward in the radial direction of the lens frame unit 11 at a slight angle through the intermediary of a concave region 21 having a substantially V- or U-shaped cross-section. The first region 19 is formed with a groove 23 extending along an inner peripheral surface thereof. The gasket unit 12 is joined integrally with the lens frame unit 11 along an outer peripheral surface thereof in a manner that the first region 19 is engaged with the groove 15 of the lens frame unit 11, the crook region 10 closely bears against the rear edge 16 of the lens frame unit 11 and the groove 23 is engaged with the rear edge 16 of the lens frame unit 11.

The second region 22 of the gasket unit 12 has a convex rib 24 formed integrally therewith and made of the soft and elastic material for the gasket unit 12 itself. This convex rib 24 extends on an outer peripheral surface of the second region 22 along a substantially intermediate level thereof. The convex rib 24 has a substantially triangular cross-section and an apex of this triangular cross-section is opposed to and spaced rearward from the rear edge (the crook region 20) by an appropriate distance. The convex rib 24 functions to strengthen a force with which the second region 22 elastically bears against the wearer's face, to assure a water-tightness between the second region 22 and the wearer's face and to prevent, for a relatively long period, the second region 22 from getting out of its normal configuration.

With the goggles put on the wearer's face, the second region 22 is pushed toward the crook region 20 defined by the rear edge of the first region 19 and thereby elastically deformed while the convex rib 24 comes in contact with the outer peripheral edge of the crook region 20 (See a chained line in FIG. 3), resulting in that a gap defined between the outer peripheral edges of the concave region 21 is closed and thereby a resistance against water flow which otherwise would be generated by the concave region 21.

Figure 4:
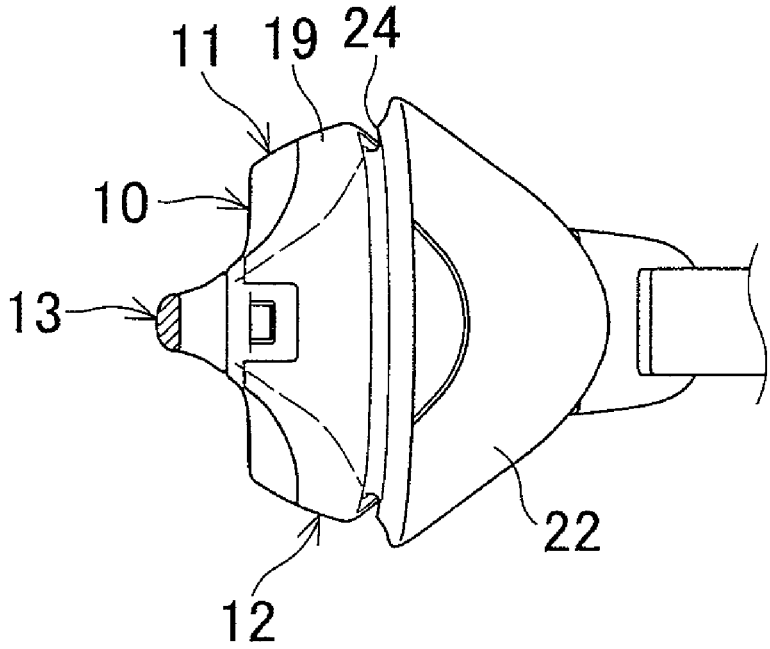
FIG. 4 is a partially cutaway sectional view taken along the line 4-4 in FIG. 2.
Figure 5:
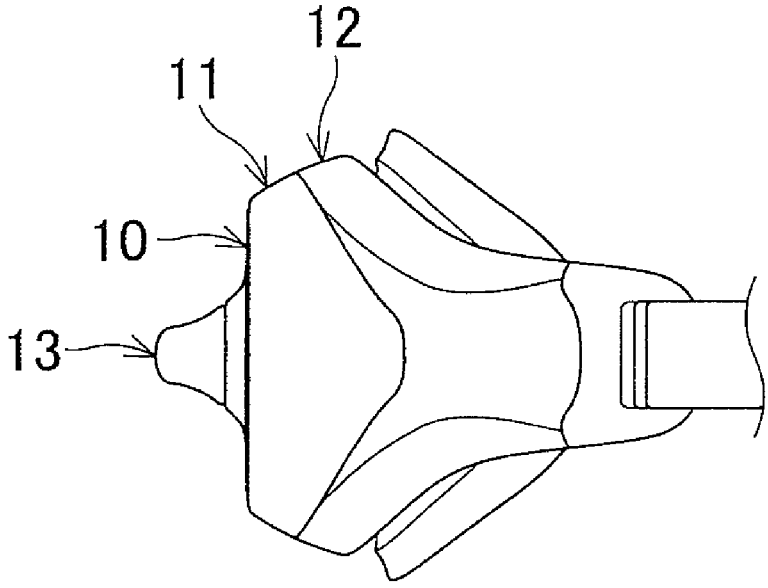
FIG. 5 is a partially cutaway side view of the goggles.
Figure 6:
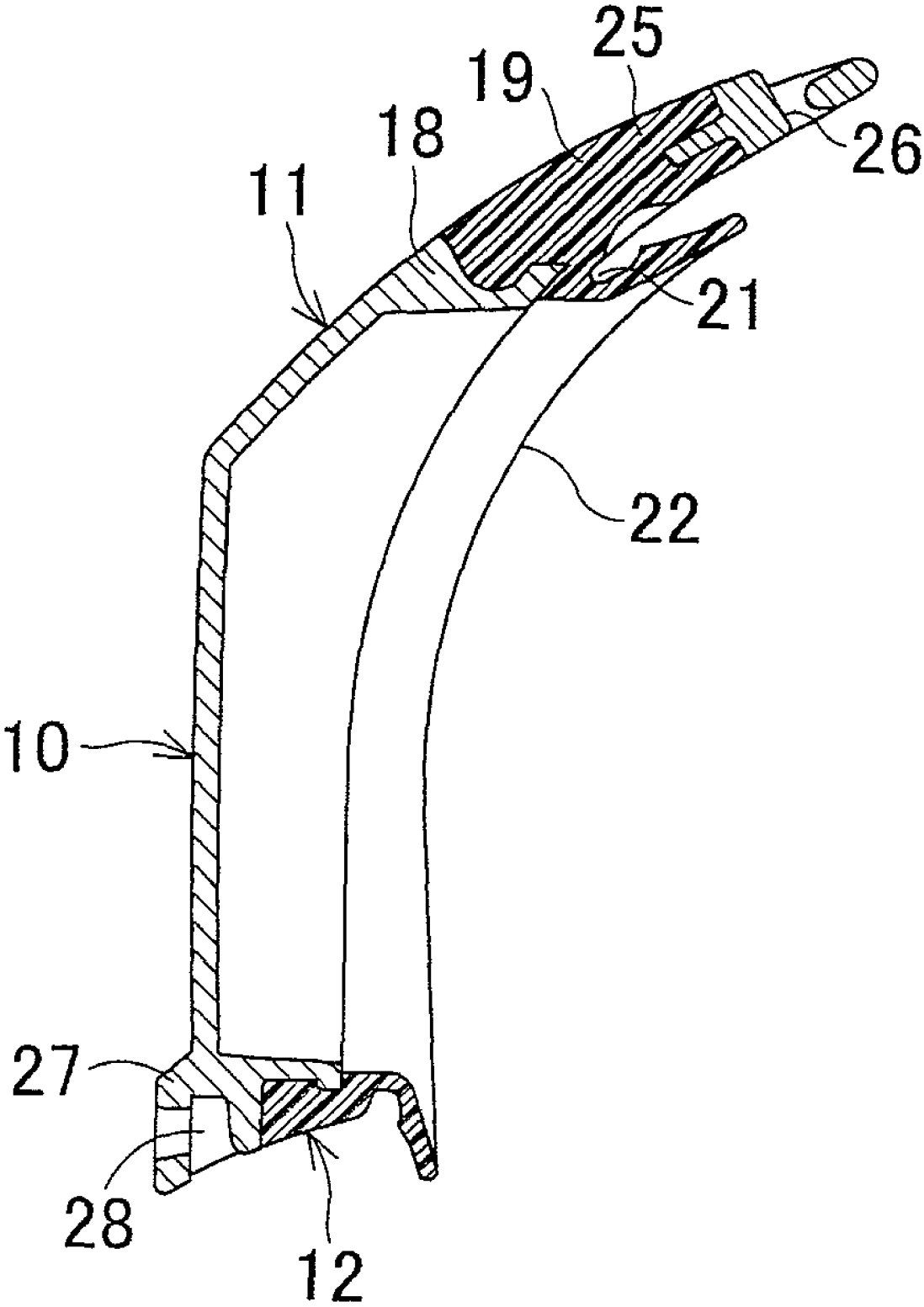
FIG. 6 is a scale-enlarged sectional view taken along the line 6-6 in FIG. 1.

Referring to FIGS. 4 through 6, the gasket unit 12 lies in the vicinity of the outer corner of the wearer's eye and extends outward in the transverse direction so as to define a distal portion 25 of the first region 19. A buckle 26 made of hard material such as thermoplastic material is connected to the distal portion 25. Specifically, the soft and elastic distal portion 25 is interposed between the outer edge 18 of the lens frame unit 11 and the buckle 26 and elastically deformable between these outer edge 18 and buckle 26.

An inner end 27 of the lens frame unit 11 lying in the vicinity of the inner corner of the wearer's eye is provided with a locking part 28 used for attachment of the nose bridge 13 (See FIG. 1). The inner surface of the locking part 28 is flush with the inner surface of the gasket unit 12 to provide a substantially smooth transition and therefore it is unlikely that the wearer might experience a discomfortable feeling as it possibly occurs when the rigid locking part due to the rigid locking part sticks out and comes in an acute contact with the wearer's face.

Referring again to FIG. 1, the nose bridge 13 is made of material which is relatively rigid and elastically deformable, for example, thermoplastic plastic material or elastomeric material, and serves to connect the inner ends of the respective lens frame units 11 with each other. The head strap 14 is made of relatively soft elastomeric material and serves to connect the paired lens frame units 11 to each other by the intermediary of the buckles 26 provided on the outer sides of the respective lens frame units 11.

The entire discloses of Japanese Patent application No. 2006-256354 filed on Sep. 21, 2006 including specification, drawings and abstract are herein incorporated by reference in its entirety.

What is claimed is:

1. Swimming goggles having frontward/rearward directions and a transverse direction being orthogonal thereto, comprising:

lens units each made of transparent hard material;

annular lens frame units each made of hard material so as to extend from a peripheral edge of the associated lens unit in said rearward direction;

annular gasket units each made of soft and elastic material so as to extend from a peripheral edge of the associated lens frame unit in said rearward direction wherein each of said gasket units comprising a first region integrally covering an outer peripheral surface of the associated lens frame unit and a second region extending from said outer peripheral surface along a rear edge of the associated gasket unit crooked inward as viewed in a radial direction of the associated lens frame unit and wherein a concave region extends along said outer peripheral surface between said rear edge and said second region;

each of said gasket units including a convex rib integrally formed with said gasket unit from said soft and elastic material of said gasket unit so as to extend along said outer peripheral surface of said second region opposed to and spaced from said rear edge of said first region in said rearward direction.

2. The goggles defined by claim 1, wherein said first region of said gasket unit extends outward in said transverse direction to define an elastically deformable distal portion including no portion of the associated lens frame unit and said distal portion include, on its outer end, a buckle made of hard material and provided integrally with said outer end so as to serve for coupling of a head strap.

3. The goggles defined by claim 1, wherein said lens unit and said lens frame unit are integrally molded from said transparent hard material as an eye cup unit.

4. The goggles defined by claim 1, wherein said eye cup unit and said gasket unit are integrally molded and thereby integrally joined to each other.

* * * * *